United States Patent [19]

Boren

[11] Patent Number: 4,489,793

[45] Date of Patent: Dec. 25, 1984

[54] CONTROL METHOD AND APPARATUS FOR FLUID DELIVERY IN A ROTARY DRILL STRING

[76] Inventor: Roy Boren, 900 N. 40th St., Birmingham, Ala. 35222

[21] Appl. No.: 376,340

[22] Filed: May 10, 1982

[51] Int. Cl.[3] ..... E21B 21/00

[52] U.S. Cl. ..... 175/71; 175/323; 175/324

[58] Field of Search ..... 175/71, 69, 100, 324, 175/317, 213, 232, 323; 166/243; 137/561 A

[56] References Cited

U.S. PATENT DOCUMENTS

| | | | |
|---|---|---|---|
| 762,808 | 6/1904 | Cushing et al. | 175/323 |
| 2,920,872 | 1/1960 | Baur et al. | 175/324 |
| 3,094,175 | 6/1963 | Jackson | 175/71 |
| 3,924,695 | 12/1975 | Kennedy | 175/69 |
| 4,245,710 | 1/1981 | Dolezal et al. | 175/324 |

FOREIGN PATENT DOCUMENTS

| | | | |
|---|---|---|---|
| 791884 | 2/1977 | U.S.S.R. | 175/100 |
| 744132 | 6/1980 | U.S.S.R. | 175/323 |

*Primary Examiner*—James A. Leppink
*Assistant Examiner*—Hoang C. Dang
*Attorney, Agent, or Firm*—Patrick F. Henry

[57] ABSTRACT

The apparatus comprises a cylindrical casing or housing with an interior passageway in which is mounted a fluid divider comprising three air divider legs each of which is a tapered plate formed with a concave cavity or air scoop with curved upper edges that are joined together in the center so that the legs diverge downwardly and outwardly in the drill string passageway of the cylindrical housing. The legs support a divider hood dome on which is mounted three separate curved plates defining three air channels. The fluid is directed into the concave scoops then into channels that lead to the outside of the housing in an upwardly direction. Fluid also spills over the air divider scoops and travels onto the bit, cooling the bit and chip removal from around the rollers.

14 Claims, 8 Drawing Figures

CONTROL METHOD AND APPARATUS FOR FLUID DELIVERY IN A ROTARY DRILL STRING

BACKGROUND OF THE INVENTION

1. Field of the Invention

The field of the invention is generally rotary drilling apparatus which utilizes fluid such as compressed air, water or other agents for cooling the bit and for other purposes and especially to the provision of some means located between the end of the drill pipe and the fluid passages in the rotary bit for the purpose of dividing and directing the air to provide a more efficient utilization thereof.

2. Description of Prior Apparatus & Methods

A conventional rotary drill string comprises the sections of drill pipe and a conventional rotary drill bit on the end thereof. It is well known to introduce fluids such as compressed air or other agents through the pipe and down the inside of the drill string to assist in drilling the hole by cooling the bit, assisting and keeping the bearings and the rollers of the bit clean and blowing (bailing) rock chips out of the hole. The relationship of the compressed air and the removal of the rock chips becomes critical in the life of a drill bit. If the velocity of the air is too fast as the air passes through the bit then a condition exists in which very small particles of rock are picked up by the fast moving air and impact against the bit causing premature wear. This condition is called sandblasting. If the velocity of the air is too slow as it passes through the bit there occurs a condition called regrinding during which the air is not moving fast enough to blow the large rock chips away from the bit and to the top of the hole. The rock chips are then crushed again and again by the bit as it rotates causing a very abrasive condition of very small particles of rock around the bit creating excessive heat by the bombardment of small bodies. Such action causes premature wear on the bit. Perhaps the single item that does the most damage to a drill bit is the rock chips that the bit cuts from the bottom of a hole. The least expensive way to remove the chips from around the bit is to blow them away with compressed air. However, as mentioned above, previously the lack of proper direction and control of the air has caused sandblasting and regrinding and excessive heat.

While there have been efforts in the prior art to control and direct the compressed air or other fluids and mixtures it has not been through the use of the apparatus of the present invention or in the method which is performed by the use of the present apparatus.

With reference to the above discussion, the following U.S. patents are noted: Nos.

2,898,086
2,951,680
3,094,175
3,095,052
3,848,683
3,899,033

SUMMARY OF THE INVENTION

The primary purpose of the present invention is to provide a means for controlling the compressed air so as to direct same from the end of the lowermost drill pipe throgh the air channels in the drill bit and to provide the control by air separation. For modification of existing drill strings the present apparatus is incorporated in an air divider subassembly, or sub, which is assembled by screwing into the end of the drill pipe and receiving the end of the drill bit screwed into the other end.

The present apparatus includes a fluid divider which comprises legs each of which has a fluid scoop or concave portion therein and the legs support an air divider hood having a dome on which are located several air divider blades directing the air through openings in the dome onto the scoop below.

The method of the present invention comprises the steps of directing the fluid such as compressed air through a passageway in the divider assembly, directing the fluid against a divider means, separating the fluid and directing same into different openings which then direct the fluid into concave portions or scoops from which the fluid is directed into passageways or channels that lead to the outside of the housing of the assembly so as to direct the fluid in an upward direction and around spiral wear bars on the outside of the housing. The fluid is also caused to spill from the divider scoops and impinge on the bit thereby cooling the bit and assisting in chip removal from the rollers on the bit. The fluid that is released from the divider through the fluid channels is mixed with the fluid from the bit creating a pressure differential which provides a suction on the chips around the bit.

Other and further objects and advantages of the present invention will become apparent upon reading the following description of a preferred embodiment taken in conjunction with the accompanying drawings.

DESCRIPTION OF A PREFERRED EMBODIMENT AND METHOD OF OPERATION

Figure 1:
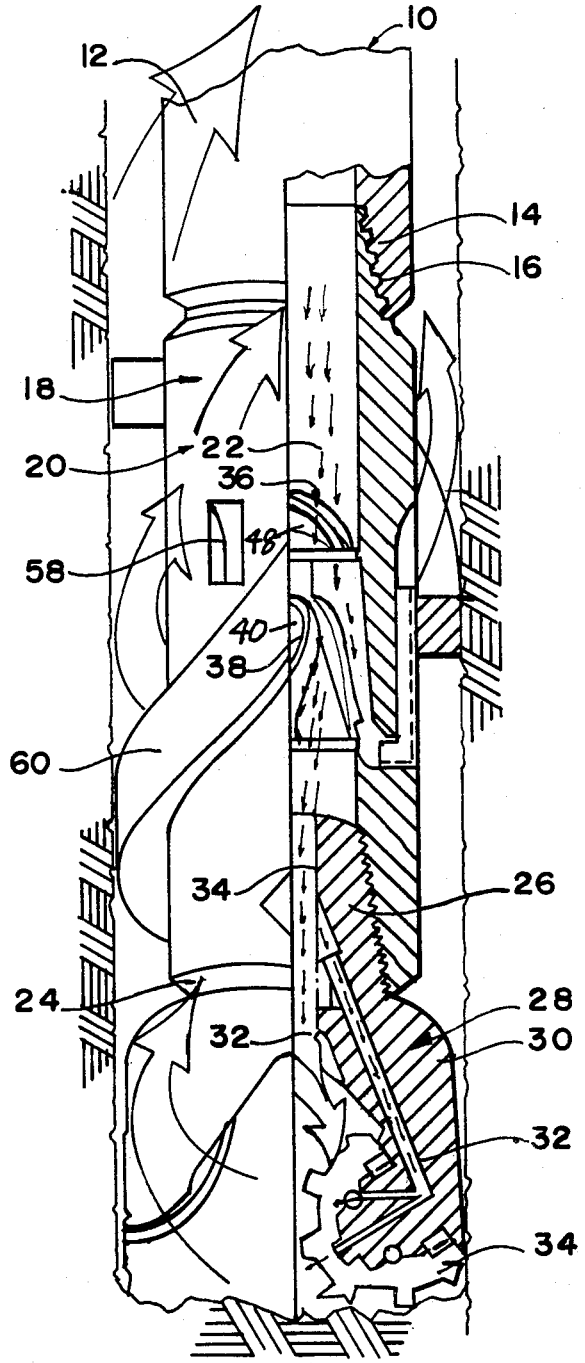
FIG. 1 is a vertical side elevation view with parts broken away of a portion of a typical drill string having the present assembly assembled therein between the drill pipe and the drill bit.
Figure 2:
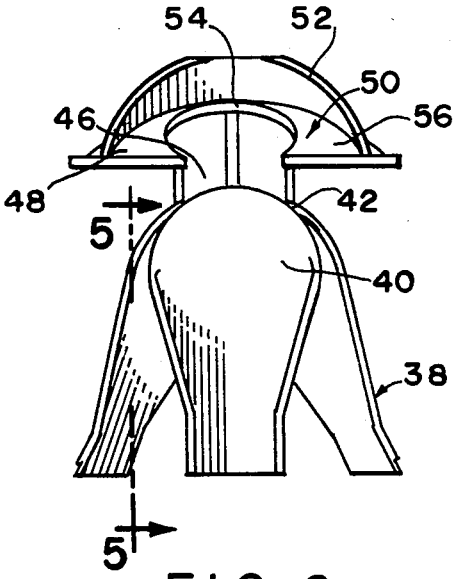
FIG. 2 is a side elevation view of the divider which is assembled inside of the air divider housing shown in FIG. 1.
Figure 3:
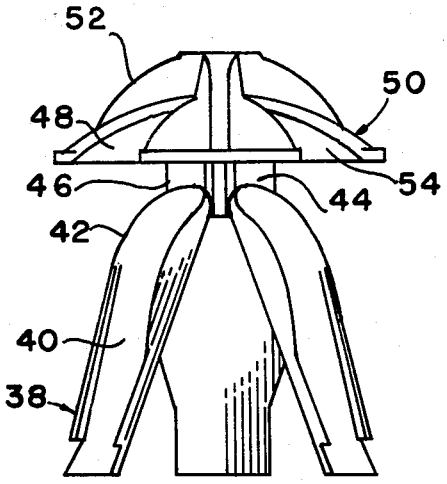
FIG. 3 is another side elevation view from a slightly different direction of the fluid divider shown in FIGS. 1 and 2.
Figure 4:
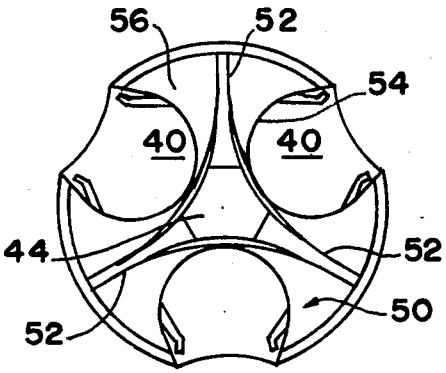
FIG. 4 is a top plan view of the air divider shown in FIGS. 2 and 3.
Figure 5:
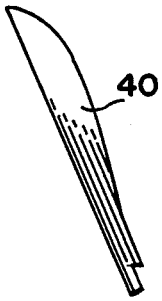
FIG. 5 is a view taken substantially along lines 5—5 in FIG. 2.
Figure 6:
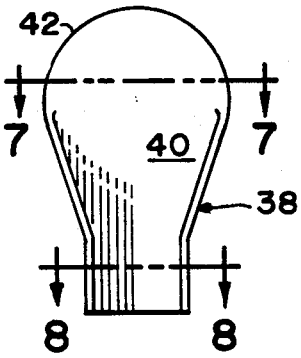
FIG. 6 is an elevation view of the fluid scoop in FIG. 5.
Figure 7:
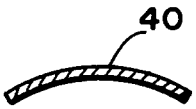
FIG. 7 is a view taken substantially along lines 7—7 in FIG. 6.
Figure 8:
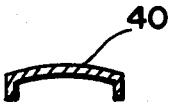
FIG. 8 is a view taken substantially along lines 8—8 in FIG. 6.

In FIG. 1 a drill string 10 comprises a conventional drill pipe 12 having a female threaded end 14 into which is threaded the male end 16 of the present sub-assembly which is designated generally by reference numeral 18. The sub-assembly 18 comprises a cylindrical housing 20 having an interior passageway 22 communicating with the passageway from the interior of the drill pipe 12.

The lower end 24 of the housing 20 is internally threaded and receives the externally threaded male end 26 of a conventional rotary drill bit 28 which comprises the usual housing 30 having air channels or air passageways 32 leading to the exterior adjacent the rotary drill bit elements 34. In the normal operation of the prior arrangement as described herein previously the fluid such as compressed air or other mixture would blow in the bottom of the hole around and against the drill bit elements and agitate the rock chips and the dirt and the like in this location. The same procedure is generally applicable to the present arrangement except that the fluid such as air is controlled as described herein. While air or water or fluid is mentioned herein various mixtures, including mud may be used as long as the substance is fluid and will move through the drill string.

Mounted in assembled relationship inside the housing 20 is a fluid control device called a fluid or air divider 36 which comprises in the present embodiment three fluid divider legs 38 each constructed from contoured metal plate or the like formed into respective concave portions defining scoops 40. Each leg 38 is enlarged at the upper edge around the air scoop 40 and curved along a circular radius to form a circular edge 42 which are joined together in the center by a web 44 on which is mounted a hood support 46 supporting a normally horizontal hood 48 comprising a dome 50 on which is mounted three curved air blades 52. Dome 50 has three open portions 54 which are located just above the air scoops 40 on respective legs 38 so that the air which is directed downwardly through the passageway 22 impinges upon each of the solid dome sections 56 and is separated by the blades 52 causing the fluid such as air to separate and to impinge upon and strike the fluid scoops 40 thereby being split downwardly through the passageway 22 and into the passageway 34 of the drill bit 28.

Thus, the compressed air or other fluid or mixture is introduced into the drill pipe 12, travels to the subassembly 18 and through the passageway 22 striking and impinging upon the hood 48 which in the present embodiment splits and separates the air or other fluid into the three separate openings defined by the space 54 in the dome 50 whereupon the air or other fluid continues and strikes the scoops 40 which direct the air into channels 58 which lead from the interior passageway 22 through the wall of the housing 18 and to the outside of the housing 20 upon which is located spiral wear bars 60 which spiral around the exterior periphery of the housing 22 thereby directing the fluid in an upwardly direction. Also, some fluid spills over the divider scoops 40 and travel through the passageway 34 and 32 to the drill bit 28 and to the drill elements 34 performing the same function as in normal drilling operation which is to cool a bit and to assist in the removal of chips from around the bit elements and rollers. The fluid released from the divider 36 and from the scoops 40 thereof is mixed with fluid such as air traveling from the bit 28 up through the drilled hole between the outside wall of the drill pipe and the wall of the hole 60. This mixture of fluid creates a pressure differential between the fluid around the pipe 12 and the housing 22 and the fluid which is escaping from the passageway 32 at the bit causing a suction on the chips around the bit 34 which assists in getting the chips away from the bit 28 and keeping them away thereafter. Also the suction action removes the most damaging element from the area where the bit is performing the work thereby greatly increasing the expected life of the bit.

While I have shown and described a particular embodiment of this invention and also a method and mode of operation thereof this is by way of illustration only because there are various alterations, changes, deviations, eliminations, substitutions and departures which may be made from the apparatus and method herein without departing from the scope of this invention as defined only by a proper interpretation of the appended claims.

What is claimed:

1. In an apparatus for controlling and directing fluid such as air which is delivered through a drill string conduit such as pipe in a hole to a drill string rotary bit through passageways in said pipe and said bit:

a control housing mounted in said drill string above said drill bit and comprising a passageway in communication with said pipe and said bit, divider means within said housing comprising a plurality of stationary first divider leg members for separating and dividing the fluid traveling downwardly through said passageway toward the bit, and a stationary divider dome supported above said leg members within said housing and within the passageway having fluid traveling downwardly therein, said dome having openings therein and means thereon for directing the fluid through said openings to and against said legs.

2. The device in claim 1, including:

openings formed in said housing and leading from the passageway in said housing beneath said divider members and outwardly between the housing and the wall of the hole which has been drilled.

3. The device in claim 2, including:

directing members on the outside of said housing for directing the fluid from the openings in said housing upwardly in said hole.

4. The device claimed in claim 1 wherein said plurality of divider leg members each comprises a concave scoop portion therein.

5. The device in claim 4, including:

individual blades on said dome having the openings therebetween located over said leg members whereby fluid is separated by said blades and directed downwardly against said concave scoop portions.

6. The device in claim 1 wherein said control housing has openings therein to the outside of the housing and means for directing the fluid through said openings and upwardly outside the housing.

7. The device in claim 6, wherein said means for directing comprises a spiral member on the outside of the housing.

8. The device in claim 1 wherein said divider leg members each has a concave scoop portion thereon, said divider dome being supported on said leg members within said housing and said passageway, and individual air blades on said dome having solid dome portions therebetween and the openings on said dome being above said concave scoop portion whereby fluid is directed by said blades downwardly against said concave scoop portions.

9. In a method for controlling and directing fluid which is delivered through a drill string pipe to a drill string rotary bit through passageways in said pipe and said bit and wherein there is a passage between the drill string pipe and the drill string bit, the steps comprising:

directing fluid through said pipe downwardly into the passage between said pipe and said bit and against a fluid divider means within said passage, separating said fluid by said fluid divider means in said passage and causing said fluid to change direction, and providing a stationary divider dome having fixed openings between blades directing said fluid, and stationary fluid scoops beneath said openings and said blades for receiving at least part of the fluid directed from said blades downwardly toward said passageways in said bit.

10. The method in claim 9 including: providing openings from said passageway into a space between the pipe and the surface of a hole being drilled, directing part of said fluid through said openings and upwardly around the outside of said pipe and causing said air to move in a spiral direction around said pipe.

11. The method of claim 10 including: directing part of said fluid downwardly into the passageways in said bit and out of said bit into said hole and around said bit.

12. The method claimed in claim 11 including providing a dome over said scoops and openings in said dome over said fluid scoops and causing said fluid to move by said blades through said openings against said fluid scoops and downwardly in said passageway leading to said bit.

13. The method in claim 12 wherein some of the fluid is directed toward a wall in the passageway and thence outwardly through an opening in the wall and upwardly between the pipe and the wall of a hole being drilled and some of the fluid is deflected downwardly through the passageway in the bit and outwardly through fluid channels in the bit and externally in the bottom of the hole and around the bit.

14. The method claimed in claim 13 wherein the fluid which is directed between the pipe and the wall of the hole is directed around the pipe and upwardly in a spiral direction.

* * * * *